US005188696A

United States Patent [19]

Good, Jr.

[11] Patent Number: 5,188,696

[45] Date of Patent: Feb. 23, 1993

[54] WRAP AROUND LABELING MACHINE

[76] Inventor: Kenneth W. Good, Jr., 11524 K-Tel Dr., Minnetonka, Minn. 55343

[21] Appl. No.: 738,662

[22] Filed: Jul. 31, 1991

[51] Int. Cl.[5] ..... B65C 9/00

[52] U.S. Cl. ..... 156/361; 156/363; 156/447; 156/540; 156/541; 156/542; 156/567

[58] Field of Search ..... 156/361, 363, 446, 447, 156/540, 541, 542, 567

[56] References Cited

U.S. PATENT DOCUMENTS

| | | | |
|---|---|---|---|
| 3,992,244 | 11/1976 | Craig et al. | 156/541 X |
| 4,270,968 | 6/1981 | Dudzik et al. | 156/361 |
| 4,416,714 | 11/1983 | Hoffman | 156/447 X |
| 4,502,910 | 3/1985 | Voltmer et al. | 156/542 X |
| 4,613,397 | 9/1986 | Buchholz | 156/567 X |
| 4,624,734 | 11/1986 | Voltmer et al. | 156/361 X |
| 4,658,982 | 4/1987 | Dudzik et al. | 156/542 X |
| 4,806,197 | 2/1989 | Harvey | 156/542 X |
| 4,840,694 | 6/1989 | Brookman et al. | 156/541 X |
| 4,842,660 | 6/1989 | Voltmer et al. | 156/542 X |

FOREIGN PATENT DOCUMENTS

| | | | |
|---|---|---|---|
| 546736 | 4/1958 | Italy | 156/446 |

*Primary Examiner*—David A. Simmons
*Assistant Examiner*—James J. Engel, Jr.
*Attorney, Agent, or Firm*—Burd, Bartz & Gutenkauf

[57] ABSTRACT

A machine for the application of pressure sensitive wrap around labels to product containers. The machine includes a rotatable product table to hold and transport the containers to be labeled, each of which is held on the table at one of a plurality of closely spaced rotatable container holding stations around the periphery of the table. Conveyor and spacer means are provided for sequentially feeding containers to be labeled to the product table and for sequentially removing the labeled containers, the rotation of the product table and the container holding stations being in timed coordination with the feeding and removing means. A plurality of spaced apart wrap around label application stations are positioned adjacent to the product table between the feeding and removing means. Each wrap around applicator station includes a supply reel of pressure sensitive label face stock carried on a releasable backing web and a takeup reel for the backing web after removal of the label therefrom. A drive roller transports the tape intermittently between the supply and takeup reels. An articulated pivoted reciprocating label applying shuttle arm directs the path of travel of the label stock and backing web between the supply and takeup reels. The end of the shuttle arm extends into the path of travel of the container holder stations on the product table so as to be in pressure engagement with the containers held on the table. The shuttle arm is reciprocated in timed coordination with rotation of the product table and container holding stations so that as a label is released from the backing web it is pressed into engagement with a product container and wrapped around the container as it rotates in its station and is transported by the product table.

19 Claims, 10 Drawing Sheets

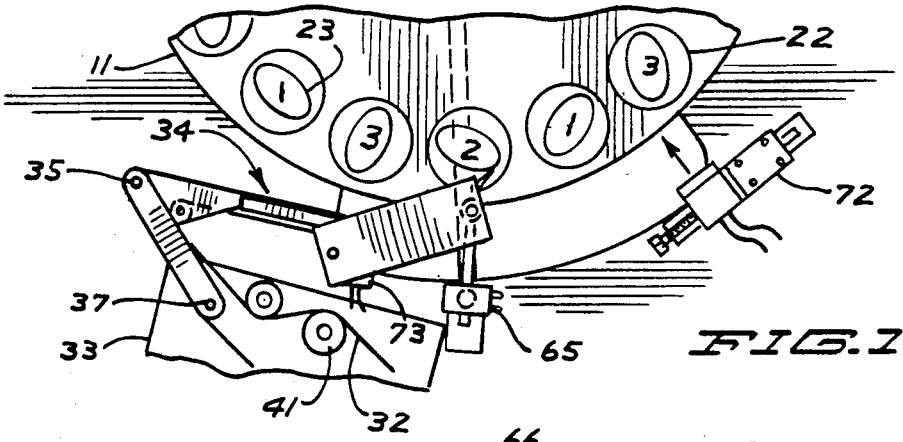
FIG. 10
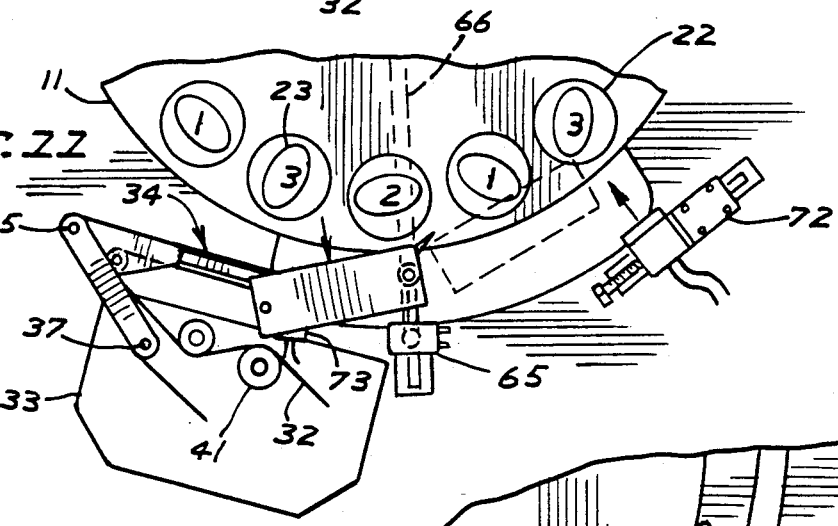
FIG. 11
FIG. 12
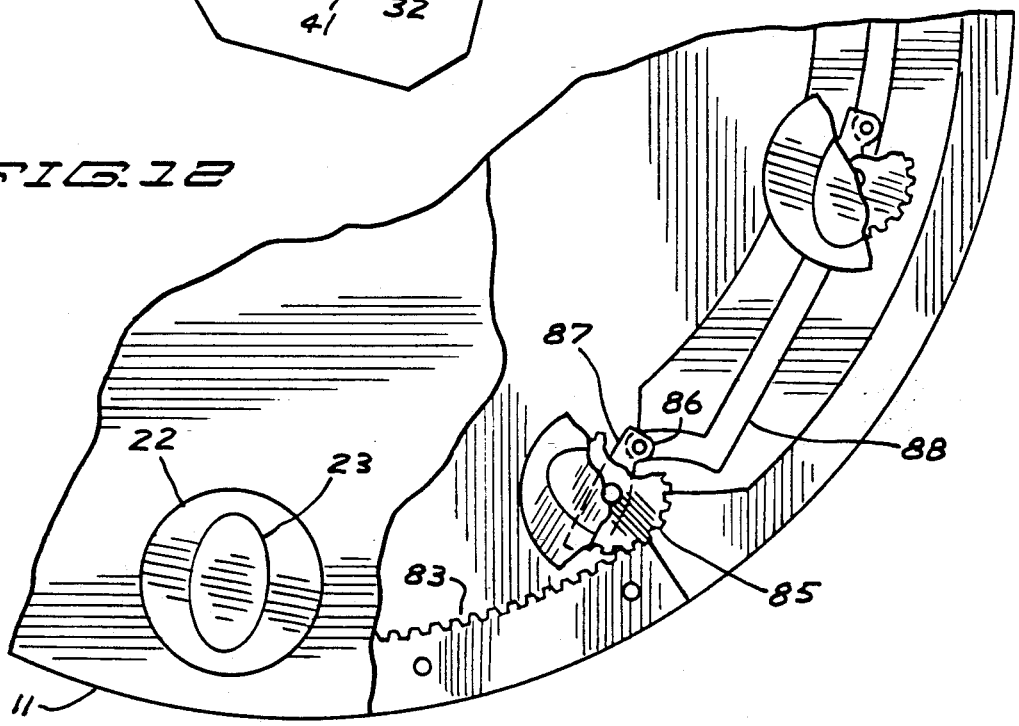

WRAP AROUND LABELING MACHINE

BACKGROUND OF THE INVENTION

FIELD OF THE INVENTION

This invention relates to a machine for applying wrap around labels to product containers. More specifically, the invention relates to a machine for the application of pressure sensitive adhesive coated wrap around labels to product containers, especially non-cylindrical containers.

It is common practice in the trade to apply separate front and back labels to many products. The front label containing the brand name is usually colorful and eye-catching. The back label is more utilitarian, containing information as to use of the product, ingredients, and the like. It is a great convenience when the information on both labels can be combined into a single label which can be applied in a single application. Applying such labels to non-cylindrical product containers presents special problems to which the present invention is especially directed.

SUMMARY OF THE INVENTION

Broadly stated, the present invention is directed to a machine for the application of pressure sensitive wrap around labels to product containers which includes a rotatable product table to hold and transport the containers to be labeled, each of which is held on the table at one of a plurality of closely spaced rotatable container holding stations around the periphery of the table. Means are provided for sequentially feeding containers to be labeled to the product table and for sequentially removing the labeled containers, the rotation of the product table and the container holding stations being in timed coordination with the feeding and removing means. A plurality of spaced apart wrap around label application stations are positioned adjacent to the product table between the feeding and removing means. Each wrap around applicator station includes a supply reel of pressure sensitive label face stock carried on a releasable backing tape or web and a takeup reel for the backing web after removal of the label therefrom. A drive roller transports the web between the supply and takeup reels. An articulated pivoted reciprocating label applying shuttle arm directs the path of travel of the label stock and backing web between the supply and takeup reels. The end of the shuttle arm extends into the path of travel of the container holder stations on the product table so as to be in pressure engagement with the containers held on the table. The shuttle arm is reciprocated in timed coordination with rotation of the product table and container holding stations so that as a label is released from the backing web it is pressed into engagement with a product container and wrapped around the container as it rotates in its station and is transported by the product table.

BRIEF DESCRIPTION OF THE DRAWINGS

The invention is illustrated by the accompanying drawings in which corresponding parts are identified by the same numerals and in which:

FIG. 1A is a schematic plan view of a complete labeling machine with a plurality of label applying stations;

FIG. 3 is a fragmentary enlarged elevation partly in section on the line 3—3 of FIG. 1 and in the direction of the arrows, showing details of a label applying station;

FIGS. 7 through 11 show the sequence of operation of the shuttle arm relative to application of a wrap around label to a single container;

FIG. 12 is a fragmentary enlarged sectional view showing means for stopping rotation of the container holding station for positioning of a container thereon, and showing the drive mechanism for individual container holding stations; and FIG. 13 is an enlarged fragmentary view partly in section showing details of construction of the label applying shuttle arm.

DETAILED DESCRIPTION OF THE PREFERRED EMBODIMENT

Figure 6:
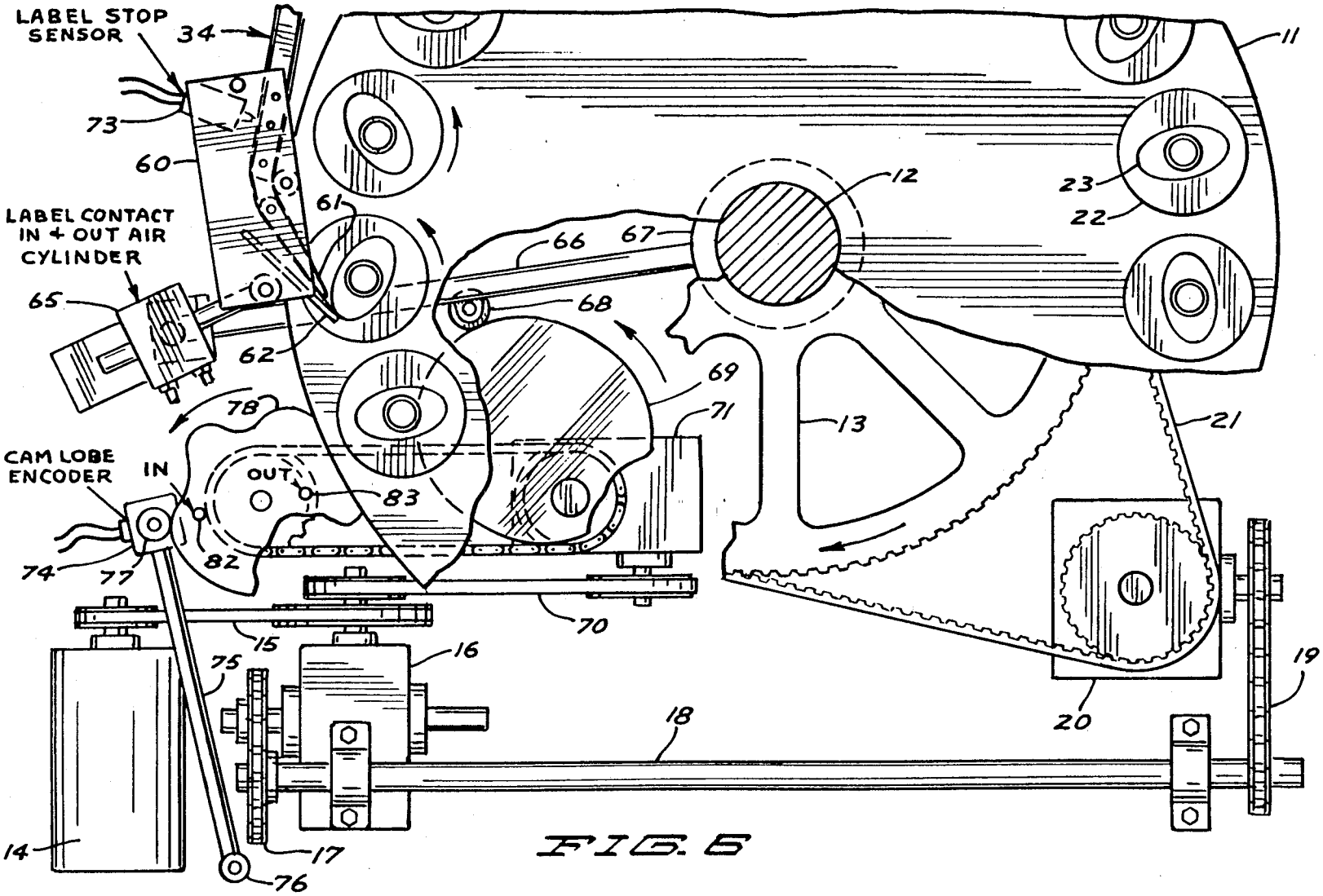
FIG. 6 is a plan view partly in section showing the label applying shuttle arm at the initiation of application of a wrap around label.

Referring now to the drawings, and particularly to FIGS. 1, 1A, 2 and 6, there is shown a label applying machine comprising a base housing 10 above which is supported a rotatable circular horizontal product table 11 secured to a common shaft 12 with a drive wheel 13 enclosed within the housing. The product table 11 is rotated clockwise, driven by motor 14 operatively connected by belt 15, gearbox 16, chain 17, shaft 18, chain 19, gearbox 20, and belt 21 to drive wheel 13, all as best seen in FIG. 6. Product table 11 includes a plurality of rotatable circular container holding stations 22 closely and uniformly spaced adjacent the perimeter of table 11. Each container holding station 22 is adapted to receive a non-cylindrical product container 23 held in place by a spring biased plunger 24 supported from a rotatable superstructure.

Figure 1:
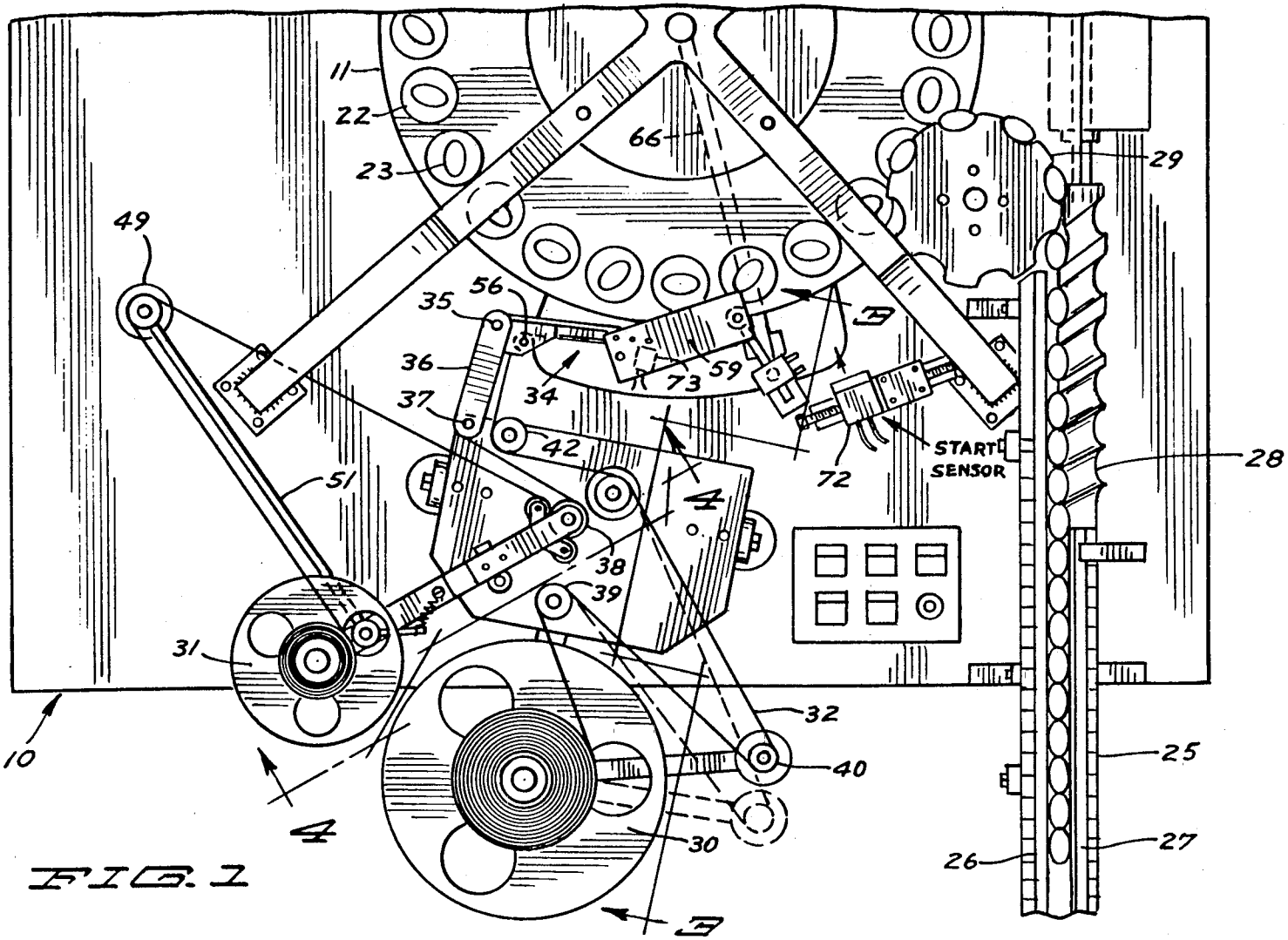
FIG. 1 is a fragmentary top plan view of the wrap around labeling machine according to the present invention showing one label applying station.
Figure 2A:
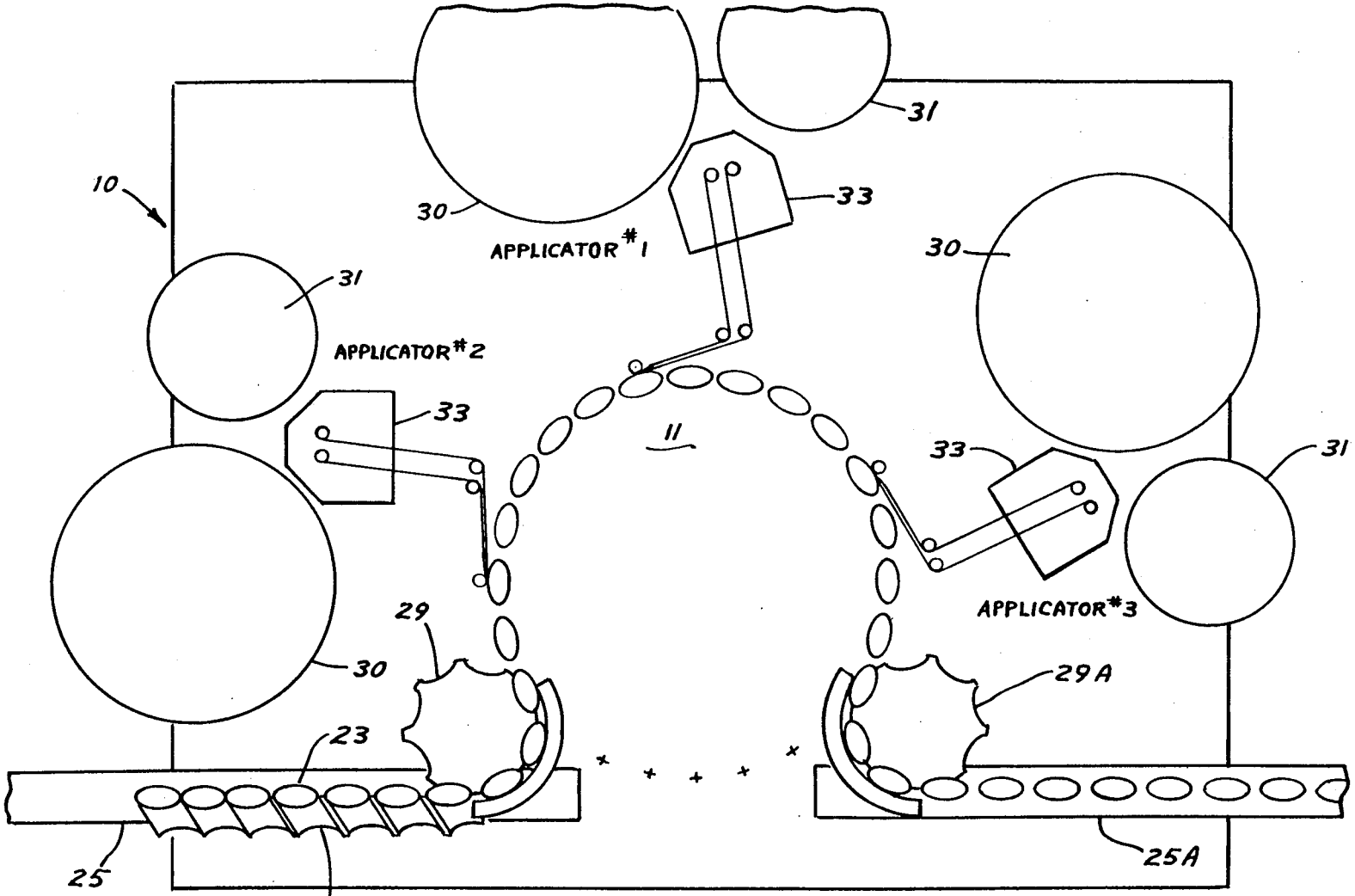
FIG. 2 is an elevation of the labeling machine as shown in FIG. 1.
Figure 2:
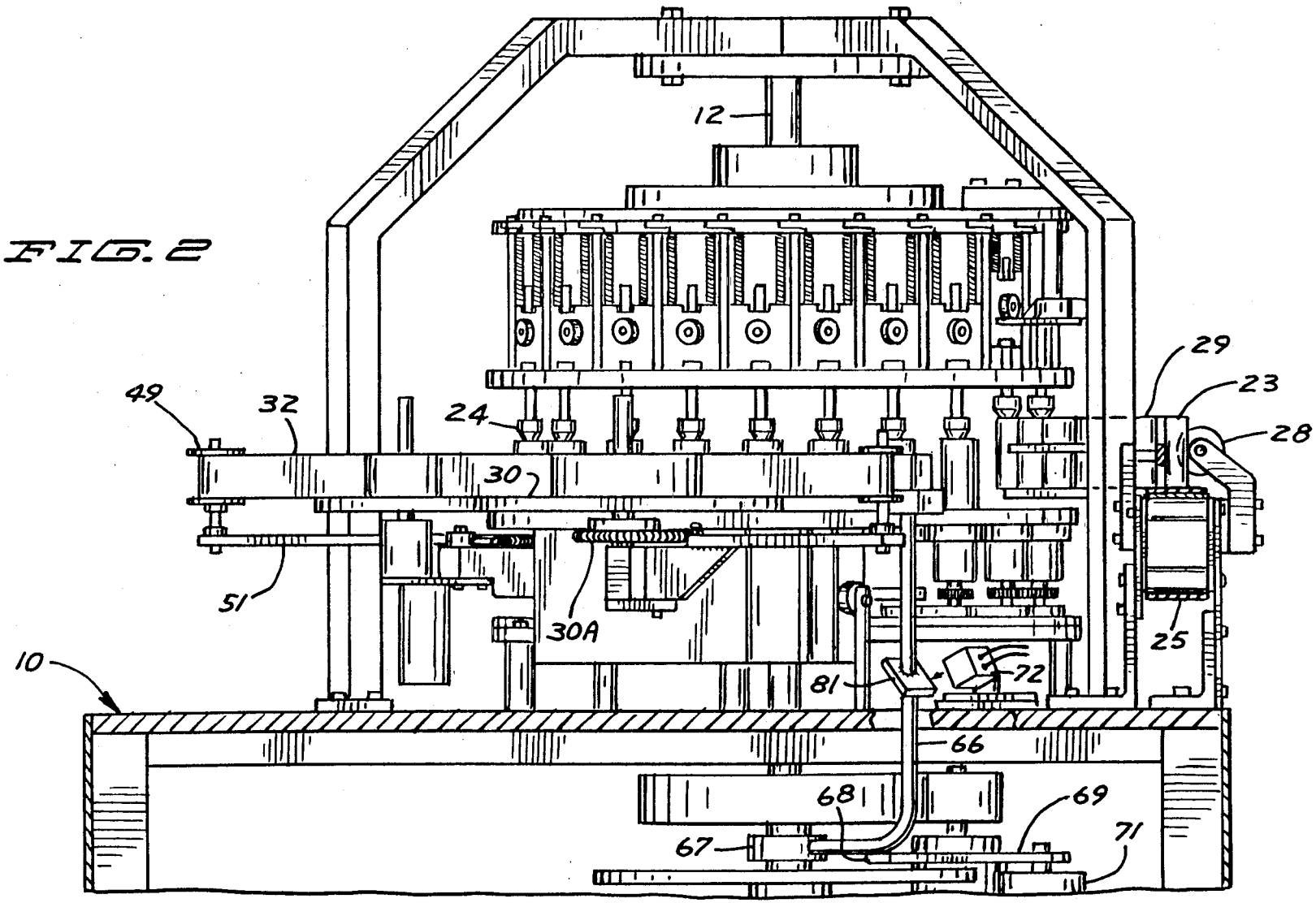

As seen in FIGS. 1 and 1A, a plurality of abutting containers 23 supported on a conveyor 25 between guides 26 and 27 are advanced to a timing screw 28 where they are separated sequentially, corresponding to the spacing between container holding stations 22, and fed to a star wheel 29 and thence to a container holding station. A corresponding star wheel 29A removes the labeled containers from the product table to a second conveyor 25A for packaging or other processing as needed. As is well known in the art, plungers 24 are lifted by cam action to release labeled containers from the product table and are lowered to engage containers being fed to the table. Conveyer 25, timing screw 28 in-feed star wheel 29, and the out-feed star wheel 29A are driven in timed coordination with the product table 11 and container holding stations 22 so that each container is delivered to a holding station in proper position for application of the wrap around label, as hereinafter described. Typical non-cylindrical containers to be labeled are toothpaste pumps, deodorant and anti-perspirant packages, and the like. The wrap around label may completely or partially surround the container.

The labeling machine as illustrated is designed for the application of three labels simultaneously. Three equally spaced apart label applying stations are positioned between the container in-feed and out-feed star wheels adjacent to the periphery of the product table. If the containers being fed to the product table are regarded as being numbered 1, 2, 3, 1, 2, 3, etc. in sequence, the labeling station closest to the in-feed star wheel applies labels to the number 2 container of each group, the next applies the label to the number 1 container, and the last applies the label to the number 3 container, all operating simultaneously. Fewer or more label applicator stations may be employed depending upon the size of the container to be labeled, the circumference of the product table, and similar circumstances.

Each label applicator station includes a supply reel 30 to hold a stock of pressure sensitive adhesive labels releasably supported on a backup tape or web 32 and a takeup reel 31 to receive the backup web after separation of the label therefrom. The positions of reels 30 and 31 are fixed relative to the remainder of the machine, as is applicator head 33. Applicator head 33 supports a reciprocating label applying shuttle arm, indicated generally at 34, which is pivotally joined at 35 to a link 36 which in turn is pivotally connected to the applicator head at 37. A coil spring 30A extending partially around the hub of supply reel 30 applies friction which prevents "free wheeling" of the supple reel.

Web 32 is driven by drive roller 38 in a circuitous path by idlers 39-49 between supply reel 30 and takeup reel 31. Drive roller 38 is carried by the applicator head 33. Idlers 39, 41, 42 and 46 are fixed and supported by applicator head 33. Idlers 43 and 44 form part of the shuttle arm 34. Idler 45 is coaxial with the pivot between shuttle arm 34 and link 36. Idler 40 is supported by a spring biased arm 50 and idler 49 is supported on a spring biased arm 51 to maintain constant tension on web 32 compensating for the change in the web travel path caused by reciprocation of the shuttle arm 34. Idlers 47 and 48 supported on yoke 52 maintain the web in driving engagement with roller 38. Yoke 52 reciprocates away from the drive roller in response to operation of handle 53 to permit threading of a new reel of web onto the drive roller. Drive roller 38 is driven by electric motor 54 (e.g. 200 steps/min. stepping motor such as Superior 172-168 sold by Superior Electric of Bristol, Connecticut). Takeup reel 31 is driven by motor 55. The web is intermittently transported in timed coordination with transport and rotation of the containers to be labeled on the product table, and reciprocation of the shuttle arm as hereinafter described..

Shuttle arm 34 includes at one end a pair of upper and lower vertically spaced apart horizontal plates 56 and 57 by which it is pivotally connected to link 36 and between which are idlers 43 and 45. One end of an elongated vertically disposed longitudinally extending guide bar 38 is likewise supported between plates 56 and 57. Bar 58 has opposed vertical surfaces along which the web 32 is guided. The opposite end of bar 58 supports a pair of upper and lower horizontal plates 59 and 60, between which idler 44 is supported, along with a further similar vertically disposed longitudinally extending tapered guide bar 61 (FIG. 13). The relative positions of guide bars 58 and 61 may be varied to accommodate product containers of different sizes and configurations. The outermost tip of guide bar 61 is a narrow small radius curved vertical edge which causes the web 32 traveling along the guide bar surfaces to make a sharp reverse turn which causes the label carried by the web to break away from the web and continue forward into contact with a container 23 as the backing web reverses its direction of travel. A resilient flap or pressure pad 62 supported between plates 59 and 60 is positioned to bear against container 23 at the point where the edge of the pressure sensitive label leaves the backing tape. Pad 62 continues to exert pressure against the label as it is applied around the periphery of the container. Plates 59 and 60 of shuttle arm 34 are pivotally connected at 63 to the piston 64 of an air cylinder 55. Cylinder 65 is actuated in coordination with the beginning of the label wrap cycle and functions to position the end of the shuttle arm in the path of the container stations 22 and to withdraw the shuttle at the completion of the labeling cycle.

Figure 9:
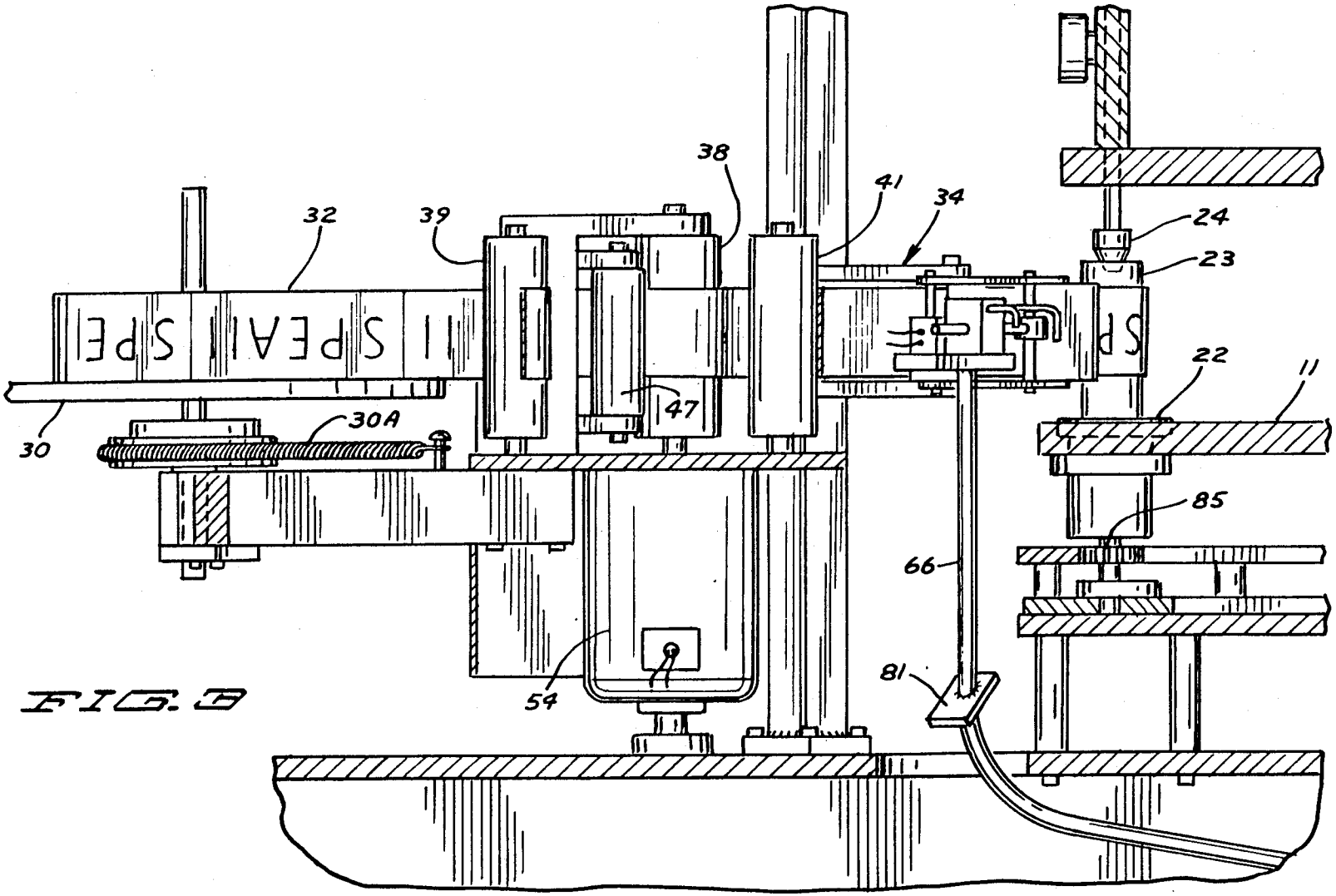
Figure 4:
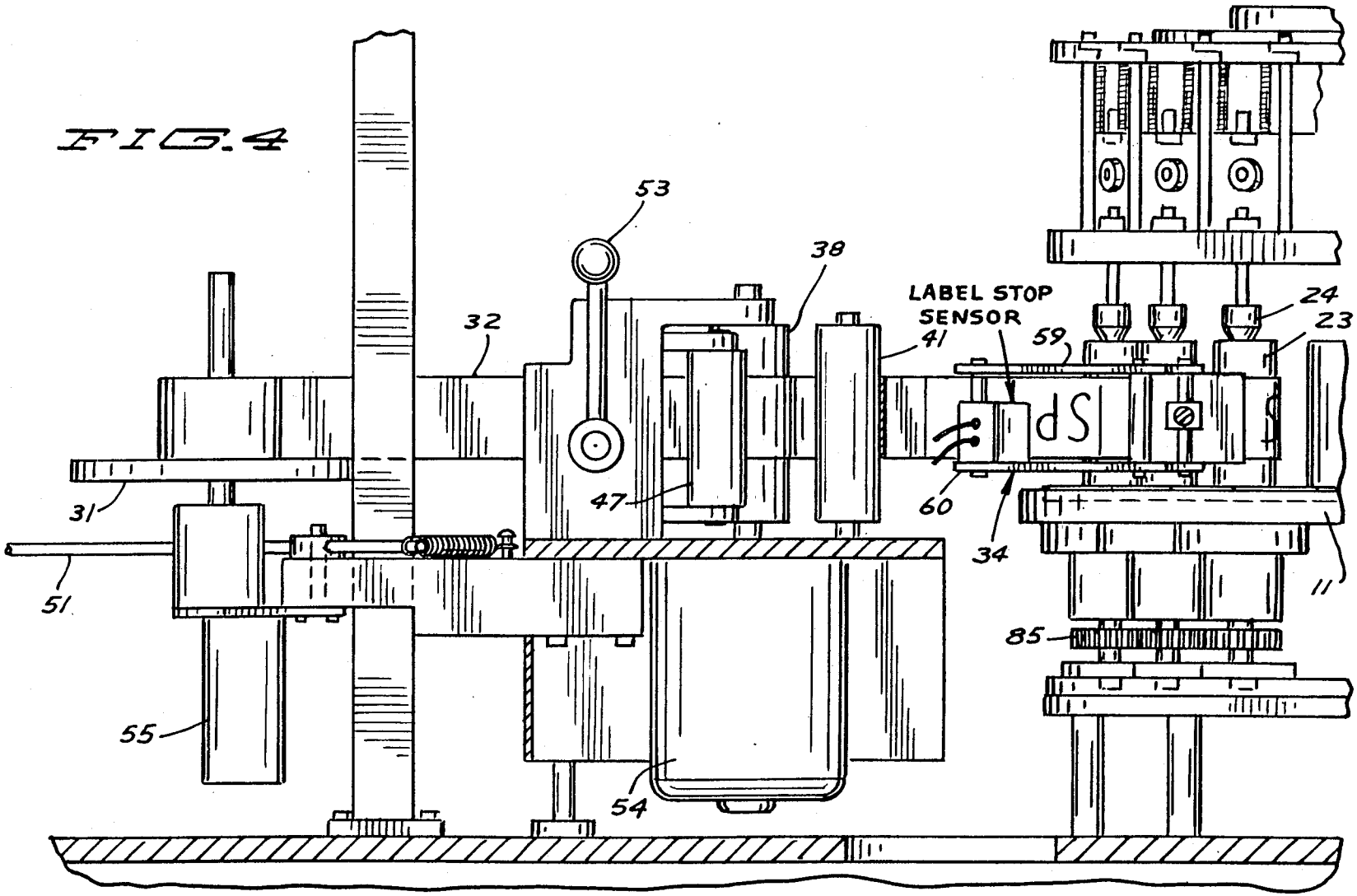
FIG. 4 is a similar elevation partly in section on the line 4—4 of FIG. 1 and in the direction of the arrows.
Figure 5:
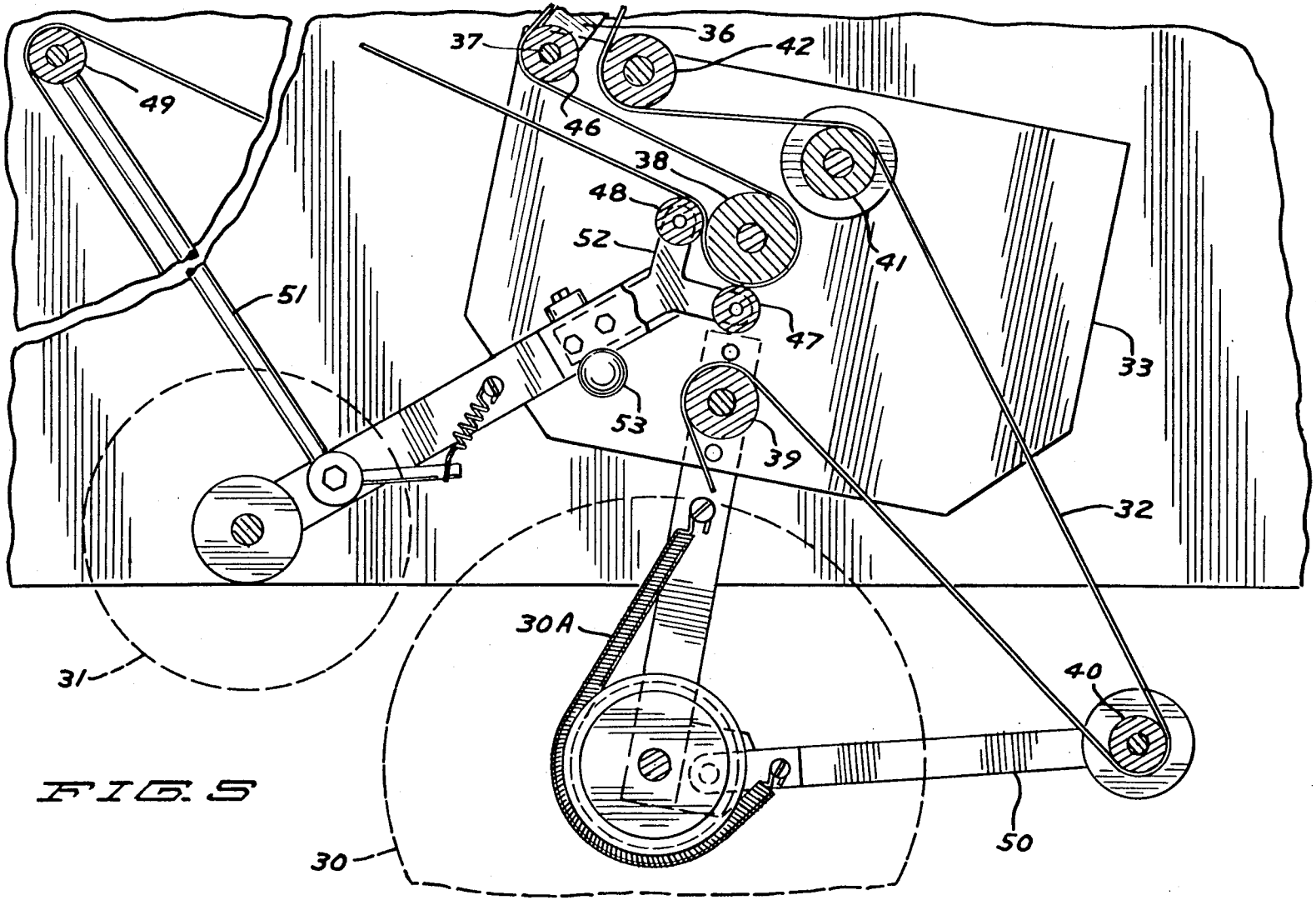
FIG. 5 is a fragmentary enlarged plan view partly in section showing details of the label applying station.
Figure 7:
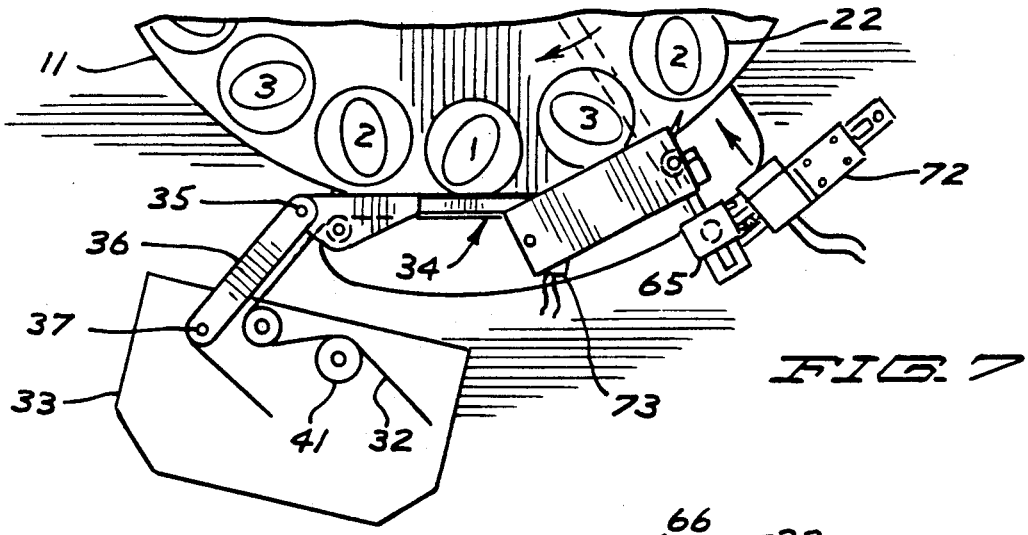
Figure 8:
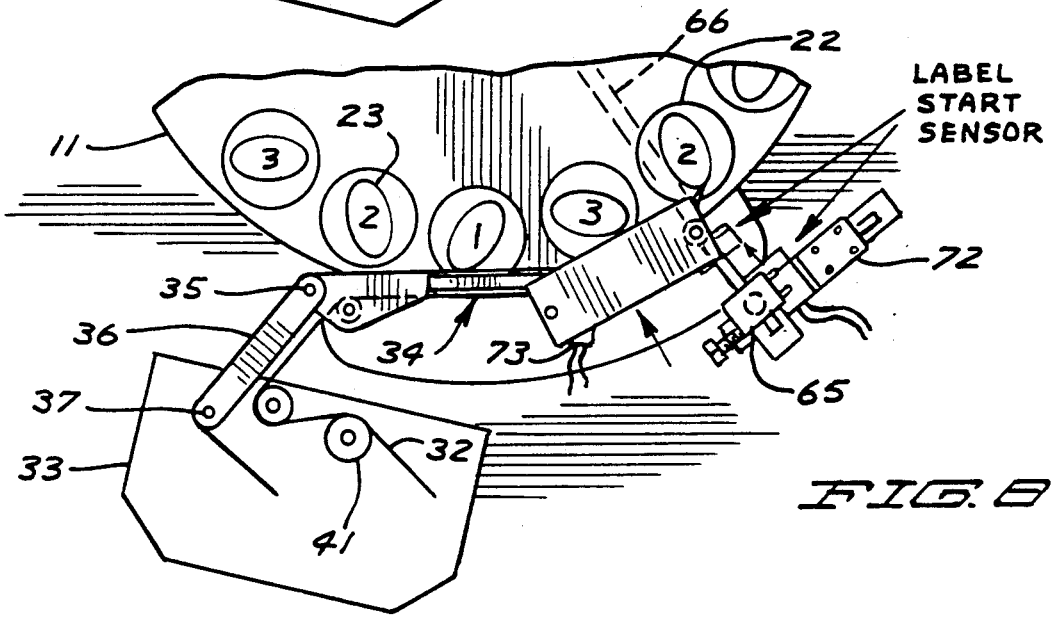
Figure 9:
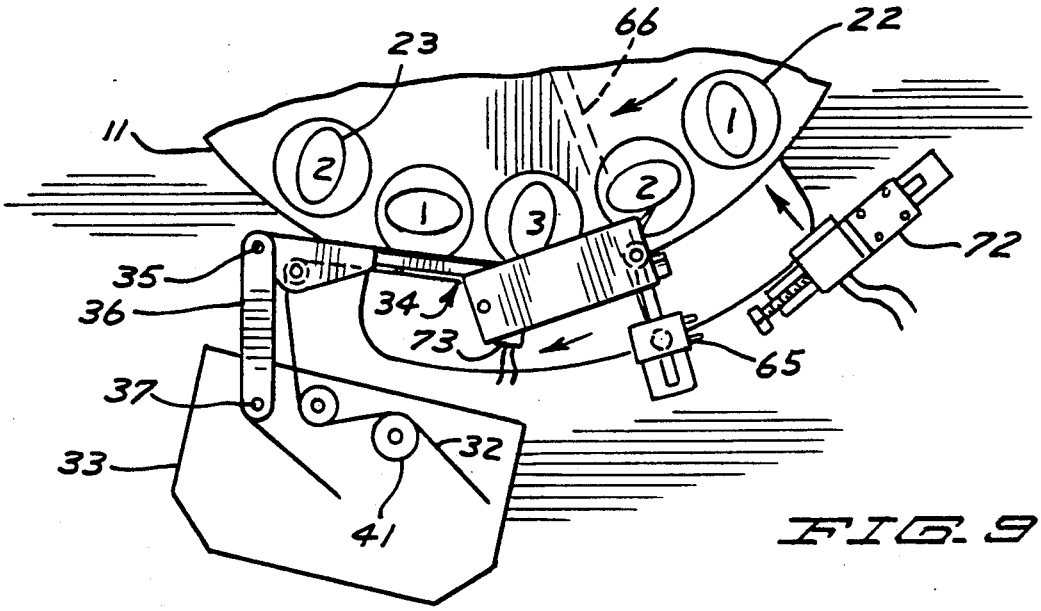
Figure 23:
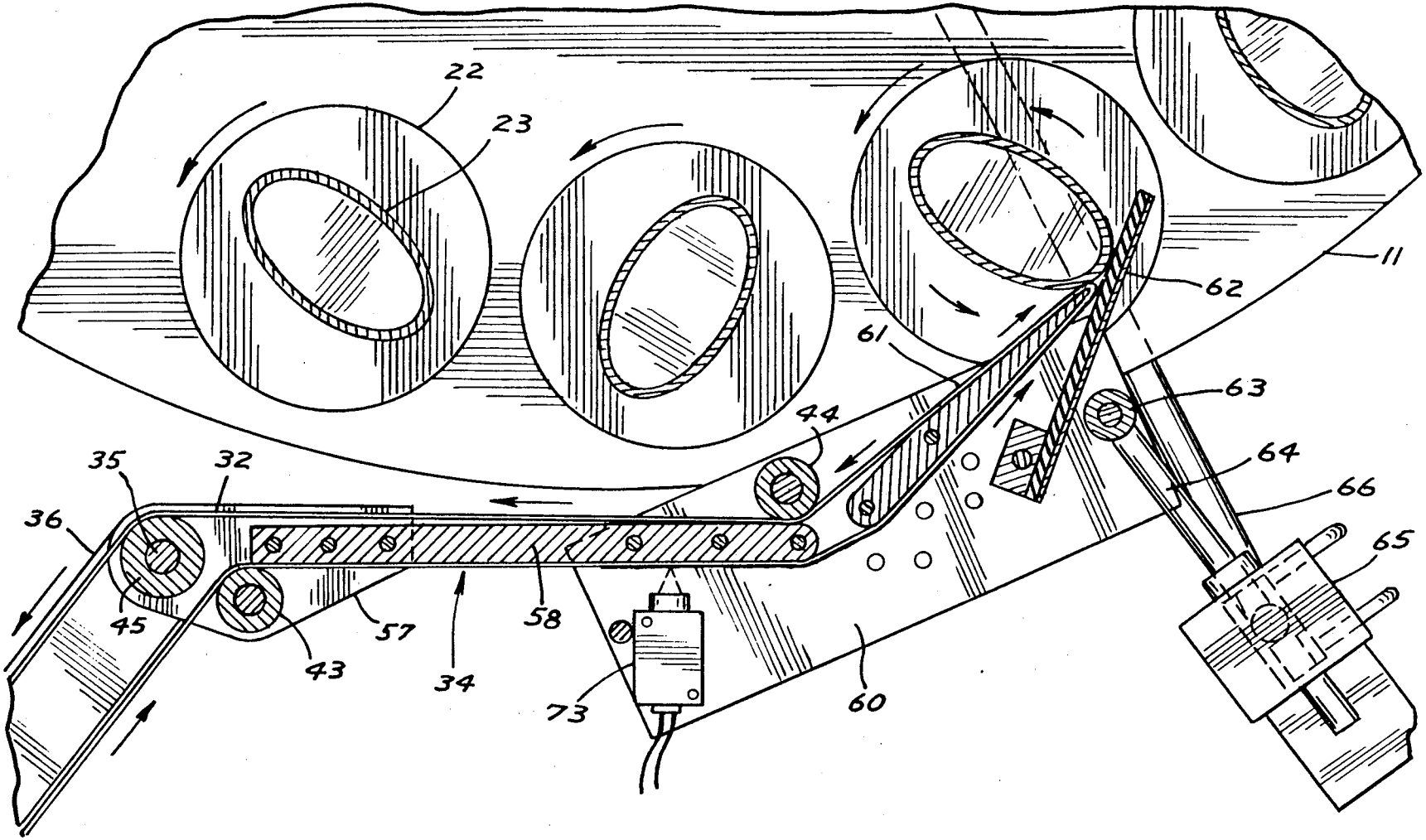

Cylinder 65 is supported at the end of a spring biased arm 66 which is supported from a collar 67 on shaft 12 which rotates freely within the collar. Arm 66 extends radially outwardly and vertically upwardly to cylinder 65. A cam follower 68 on arm 66 engages the edge of cam 69 (FIG. 6) which through arm 66 causes reciprocation of the shuttle arm 34 during the labeling cycle. Cam 69 is driven by drive motor 14 through gear box 16, belt 70 and gear box 71. Thus, as seen by comparison of FIGS. 7 through 11, as the container being labeled is carried by rotation of product table 11, the shuttle arm 34 follows the container through the labeling cycle. FIG. 7 shows a container 2 as it approaches the label applicator. When container 2 is in position to receive the label, cylinder 65 is actuated by label start sensor 72 (e.g. Mini-beam 312 CV sold by Banner Engineering of Minneapolis, Minnesota). Simultaneously tape drive motor 54 is actuated to deliver a single label to be applied, at a speed coordinated with the rotation of the container as described hereinafter. As piston 64 is extended the end of the shuttle arm is moved into the path of the container holding stations. As a label breaks away from backing web 32 it is pressed into contact with the container. As it revolves with rotation of table 11, the container rotates, as described hereinafter. As the container revolves and rotates it remains at all times in contact with the label applicator pad as the shuttle arm is reciprocated in one direction by action of cam 69 and arm 66 as seen in FIGS. 9 and 10. At the end of the labeling cycle cylinder 65 is actuated by label stop sensor 73, (e.g Omni-beam OSBFP sold by Banner Engineering) causing the applicator end of the shuttle arm to be retracted out of the path of travel of the container holders, as seen in FIG. 11. Sensor 73 detects the upstream end edge of the next to be applied label. Then the shuttle arm is reciprocated in the opposite direction to the broken line position ready to apply that next label to the next container 2, and the cycle is repeated. At the same time, labels are being applied in identical fashion to containers 1 and 3 by applicators 1 and 3, respectively.

Intermittent feeding of label stock for application by the shuttle arm is controlled in coordination with the travel of the containers and shuttle arm. An incremental magnetic-optical encoder 74 (e.g. Qube Roto-pulser Model 32 sold by Dynapar of Gurnee, Illinois) is supported at the end of an spring biased arm 75 pivotally attached at 76 to the machine frame. A cam follower 77 carried by encoder 74 engages lobe cam 78 which is rotated in timed relation with cam 69 by chain 80. A plate 81 on the vertical extension of arm 66 interrupts a light beam to activate label start sensor 72 to turn on web drive motor 54 at the start of the labeling cycle. Web drive motor 54 is then actuated by encoder 74 to feed a single label to the applicator at the end of the shuttle arm upon actuation of cylinder 65 on its "in"

stroke and to deactivate the motor upon initiation of the "out" stroke, signalled by reflectors 82 and 83, respectively, on lobe cam 78.

In order for the label to be properly applied, it is essential that the container to be labeled is precisely positioned on the product table 11. In order to insure proper positioning, each container holding station 22 had a recess corresponding to the non-cylindrical cross-section of the container. Revolution of the container holding station is stopped momentarily as the container 23 moves from the star wheel 29 to the product table. As best seen in FIG. 12, a fixed partial ring gear 83 is supported below product table 11. Ring gear 83 extends about 270 degrees around the periphery from the star wheel 29. Each container holding station is rotated by virtue of a pinion 85 engaging ring gear 83 as table 11 is rotated. As each container holding station travels between the product discharge star wheel 29A and feeding star wheel 29, it does not rotate. A cam follower 86 is carried on arm 87, which in turn is fixed to the shaft of pinion 85. Follower 86 engages stationary cam track 88 which extends between the discharge and feeding stations. As each container holding station approaches feeding star wheel 29 the follower engages the approximately right dog leg in the cam track which rotates the holding station to the proper position for receiving a container to be labeled and the holding station is stopped momentarily as the container to be labeled is fed into position. Follower 86 immediately disengages track 88 and pinion 88 engages the ring gear 83 to rotate the holding station for application of the label.

In operation of the machine with reference to applicator 2, a plurality of containers 23 to be labeled are introduced to conveyer 25 and fed in spaced apart sequence by timing screw 28 and star wheel 29 to the individual container holding stations 22 on the perimeter of product table 11. Each container is precisely positioned relative to the shuttle arm. Starting with shuttle arm 34 in position for initiation of a labeling cycle, in response to rotation of cam 69, as the container 2 approaches the end of the label applicator arm the position of the arm is sensed by label start sensor 72 and drive motor 54 is activated. Virtually simultaneously encoder 74 initiates feeding of web 32 and cylinder 65 is actuated to move the end of the applicator arm into contact with the container 2 to be labeled. As the container rotates and revolves with rotation of the product table 11 the arm 34 is reciprocated in one direction in response to rotation of cam 69 until the label is applied. The relative intermittant speed of the web feeder motor 54 is coordinated with the rotation of the container through pulses transmitted to the stepping motor by the encoder 74. The completion of the application of the label is sensed by stop sensor 73 to stop the web feed until the beginning of the next labeling cycle. At the same time cylinder 65 is actuated to withdraw the end of the applicator arm out of the path of the traveling containers and the applicator arm 34 is reciprocated in the opposite direction responsive to rotation of cam 69 into position to initiate the next labeling cycle. Simultaneously, wrap around labels are applied to containers 1 and 3 by applicators 1 and 3, respectively, in the identical manner and the labeled containers are removed sequentially by star wheel 29A onto conveyer 25A for whatever further handling is required. The labeling cycle is repeated continuously as necessary.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A machine for the application of pressure sensitive wrap around labels to containers which comprises:

(A) a rotatable product table to hold and transport containers to be labeled, (B) a plurality of rotatable container holding stations around the periphery of said product table, (C) means for sequentially feeding containers to be labeled to said product table and means for sequentially removing labeled containers therefrom, (D) means for rotating said product table and said container holding stations in times coordination with said feeding and removing means, (E) a plurality of spaced apart label applicator stations positioned adjacent said product table between said feeding and removing means, each applicator station including:

(1) a supply reel of pressure sensitive label face stock carried on a releasable backing web and a takeup reel for said backing web, (2) an articulated pivoted reciprocating label applying shuttle arm having guide means for directing the path of travel of said label stock and backing web between said supply and takeup reels, (3) means adjacent the end of said shuttle arm for extending the end of the arm into the path of travel of said container holder stations in pressure engagement with containers held therein, and retracting the arm away therefrom, (4) drive means for transporting said web in intermittent times coordination with said shuttle arm and rotation of the container holding stations comprising:

(a) a drive roller engageable by said web, (b) a stepping motor for intermittently driving said roller, and (c) means for actuating said motor in times coordination with reciprocation of the shuttle arm and rotation of the container holder station, and (5) means for reciprocating said shuttle arm in times coordination with rotation of said product table.

2. A labeling machine according to claim 1 wherein said means for extending the end of the shuttle arm into and out of the path of travel of the container holder stations comprises a fluid actuated cylinder, the end of the piston of which is pivotally connected adjacent to the end of said shuttle arm.

3. A labeling machine according to claim 2 wherein said means for reciprocating the shuttle arm comprises:

(A) a pivoted radial arm supporting said fluid actuated cylinder, (B) a cam follower on said radial arm, (C) a rotary cam engaged by said cam follower, and (D) drive means for rotating said cam in times coordination with rotation of said product table.

4. A machine according to claim 1 wherein said means for actuating the stepping motor comprises:

(A) a rotary lobe cam driven in timed coordination with said cam controlling reciprocation of the shuttle arm, (B) a cam follower engaging said lobe cam, (C) an encoder transmitter responsive to revolutions of said follower, and (D) control means for said stepping motor responsive to the encoder transmissions.

5. A machine according to claim 1 wherein said shuttle arm includes:

(A) a smooth edged vertically disposed longitudinally extending web guide bar at its free end, (B) idler rollers to guide the web in a sharp reverse turn around said smooth edge to release a label from the web, and (C) a pressure pad adjacent to the end of the web guide bar to press the released label into contact with a container.

6. A machine according to claim 5 wherein said web guide bar is tapered toward its end edge.

7. A machine for the application of a pressure sensitive wrap around labels to containers which comprises:

(A) a rotatable product table to hold and transport containers to be labeled, (B) a plurality of rotatable container holding stations around the periphery of said product table, (C) means for sequentially feeding containers to be labeled to said product table and means for sequentially removing labeled containers therefrom, (D) means for rotating said product table and said container holding stations in times coordination with said feeding and removing means, (E) a plurality of spaced apart label applicator stations positioned adjacent said product table applicator stations positioned adjacent said product table between said feeding and removing means, each applicator station including:

(1) a supply reel of pressure sensitive label face stock carried on a releasable backing web and a takeup reel for said backing web, (2) an articulated pivoted reciprocating label applying shuttle arm having vertically disposed longitudinally extending guide means for directing the path of travel of said label stock and backing web between said supply and takeup reels, (3) a fluid actuated cylinder disposed adjacent the end of said shuttle arm and having a piston, the end of which is pivotally connected thereto for extending the end of the arm into the path of travel of said container holder stations in pressure engagement with containers held therein, and retracting the arm away therefrom, (4) sensor actuated drive means for transporting said web in intermittent times coordination with said shuttle arm and rotation of the container holding stations comprising:

(a) a drive roller engageable by said web, (b) a stepping motor for intermittently driving said roller, and (c) means for actuating and controlling said motor in times coordination with reciprocation of the shuttle arm and rotation of the container holder station, and (5) cam actuated drive means for reciprocating said shuttle arm in times coordination with rotation of said product table.

8. A labeling machine according to claim 7 wherein said means for reciprocating the shuttle arm comprises:

(A) a pivoted radial arm supporting said fluid actuated cylinder, (B) a cam follower on said radial rm, (C) a rotary cam engaged by said cam follower, and (D) drive means for rotating said cam in times coordination with rotation of said product table.

9. A labeling machine according to claim 8 wherein said fluid actuated cylinder is actuated by a label start sensor to extend the end of the shuttle arm into the path of travel of the container holder stations and said cylinder is actuated by a label stop sensor to retract the end of the shuttle arm therefrom.

10. A labeling machine according to claim 9 wherein said label start sensor is actuated by movement of said radial arm.

11. A machine according to claim 7 wherein said means for actuating and controlling the stepping motor comprises:

(A) a rotary lobe cam driven in timed coordination with said cam controlling reciprocation of the shuttle arm, (B) a cam follower engaging said lobe cam, (C) an encoder transmitter responsive to revolutions of said follower, and (D) control means for regulating the speed of said stepping motor responsive to the encoder transmissions.

12. A machine according to claim 7 wherein said shuttle arm includes:

(A) a vertically disposed longitudinally extending web guide bar having a small radius arcuate smooth vertical edge at its free end, (B) idler rollers adjacent to said bar guide to guide the web in a sharp reverse turn around said smooth edge to release a label from the web, and (C) a pressure pad adjacent to the end of the web guide bar to press the released label into contact with a container.

13. A machine according to claim 12 wherein said web guide bar is tapered toward its smooth small radius end edge.

14. A machine for the application of pressure sensitive wrap around labels to container which comprises:

(A) a rotatable product table to hold and transport containers to be labeled, (B) a plurality of rotatable container holding stations around the periphery of said product table, (C) means for sequentially feeding containers to be labeled to said product table and means for sequentially removing labeled containers therefrom, (D) means for rotating said product table and said container holding stations in times coordination with said feeding and removing means, (E) a plurality of spaced apart label applicator stations positioned adjacent said product table between said feeding and removing means, each applicator station including:

(1) a supply reel of pressure sensitive label face stock carried on a releasable backing web and a takeup reel for said backing web, (2) an articulated pivoted reciprocating label applying shuttle arm having guide means for directing the path of travel of said label stock and backing web between said supply and takeup reels, (3) means adjacent the end of said shuttle arm for extending the end of the arm into the path of travel of said container holder stations in pressure engagement with containers held therein, and retracting the arm away therefrom, which means comprises a fluid actuated cylinder, the end of the piston of which is pivotally connected adjacent to the end of said shuttle arm, said fluid actuated cylinder being actuated by a label start sensor to extend the end of the shuttle arm into the path of travel of the container holder stations and said cylinder being actuated by a label stop sensor to retract the end of the shuttle arm therefrom, (4) drive means for transporting said web in intermittent times coordination with said shuttle arm and rotation of the container holding stations, and (5) means for reciprocating said shuttle arm in times coordination with rotation of said product table comprising:

(a) a pivoted radial arm supporting said fluid actuated cylinder, (b) a cam follower on said radial arm, (c) a rotary cam engaged by said cam follower, and (d) drive means for rotating said cam in times coordination with rotation of said product table.

15. A labeling machine according to claim 14 wherein said label start sensor is actuated by movement of said radial arm.

16. A labeling machine according to claim 14 wherein said drive means for said web comprises:

(A) a drive roller engageable by said web, (B) a stepping motor for intermittently driving said roller and, (C) means for actuating said motor in timed coordination with reciprocation of the shuttle arm and rotation of the container holder station.

17. A machine according to claim 16 wherein said means for actuating the stepping motor comprises:

(A) a rotary lobe cam driven in times coordination with said cam controlling reciprocation of the shuttle arm, (B) a cam follower engaging said lobe cam, (C) an encoder transmitter responsive to revolutions of said follower, and (D) control means for said stepping motor responsive to the encoder transmissions.

18. A machine according to claim 14 wherein said shuttle arm includes:

(A) a smooth edged vertically disposed longitudinally extending web guide bar at its free end, (B) idler rollers to guide the web in a sharp reverse turn around said smooth edge to release a label from the web, and (C) a pressure pad adjacent to the end of the web guide bar to press the released label into contact with a container.

19. A machine according to claim 18 wherein said web guide bar is tapered toward its end edge.

* * * * *

UNITED STATES PATENT AND TRADEMARK OFFICE

CERTIFICATE OF CORRECTION

PATENT NO. : 5,188,696

DATED : February 23, 1993

INVENTOR(S) : Kenneth W. Good

It is certified that error appears in the above-identified patent and that said Letters Patent is hereby corrected as shown below:

Col. 6, line 36, "times" should be ---timed---

Col. 6, line 47, "times" should be ---timed---

Col. 6, line 61, "times" should be ---timed---

Col. 7, line 27, "times" should be ---timed---

Col. 7, line 30-32, "applicator stations positioned adjacent said product table" should be deleted Col. 7, line 51, "times" should be ---timed---

Col. 7, line 58, "times" should be ---timed---

Col. 7, line 62, "times" should be ---timed---

Col. 7, line 68, "rm" should be ---arm---

Col. 8, line 2, "times" should be ---timed---

Col. 8, line 40, "container" should be ---containers---

Col. 8, line 49, "times" should be ---timed---

Col. 9, line 10, "times" should be ---timed---

Col. 9, line 14, "times" should be ---timed---

Col. 9, line 21, "times" should be ---timed---

Col. 10, line 9, "times" should be ---timed---

UNITED STATES PATENT AND TRADEMARK OFFICE

CERTIFICATE OF CORRECTION

PATENT NO. : 5,188,696

DATED : February 23, 1993

INVENTOR(S) : Kenneth W. Good

It is certified that error appears in the above-identified patent and that said Letters Patent is hereby corrected as shown below:

Col. 9, line 10, "times" should be ---timed---

Col. 9, line 14, "times" should be ---timed---

Col. 9, line 21, "times" should be ---timed---

Col. 10, line 9, "times" should be ---timed---

Signed and Sealed this

Second Day of November, 1993

*Attest:*

Bruce Lehman

BRUCE LEHMAN

*Attesting Officer*

*Commissioner of Patents and Trademarks*